US006500030B2

(12) United States Patent
Fischer et al.

(10) Patent No.: US 6,500,030 B2
(45) Date of Patent: Dec. 31, 2002

(54) PLUG CONNECTOR

(75) Inventors: Harald Walter Fischer, Remscheid (DE); Dirk Koburg, Remscheid (DE)

(73) Assignee: Delphi Technologies, Troy, MI (US)

( * ) Notice: Subject to any disclaimer, the term of this patent is extended or adjusted under 35 U.S.C. 154(b) by 0 days.

(21) Appl. No.: 09/774,273

(22) Filed: Jan. 30, 2001

(65) Prior Publication Data

US 2001/0029131 A1 Oct. 11, 2001

(30) Foreign Application Priority Data

Feb. 16, 2000 (DE) ..... 100 06 890

(51) Int. Cl.[7] ..... H01R 13/40
(52) U.S. Cl. ..... 439/701; 439/595
(58) Field of Search ..... 439/701, 595, 439/594, 752, 587, 599, 592

(56) References Cited

U.S. PATENT DOCUMENTS 4,596,436 A * 6/1986 Kraemer et al. ..... 439/701
5,980,319 A * 11/1999 Yildiz et al. ..... 439/595

FOREIGN PATENT DOCUMENTS

| | | |
|---|---|---|
| DE | 197 12 831.9 | 3/1997 |
| DE | 100 06 890.1 | 11/2000 |

* cited by examiner

*Primary Examiner*—P. Austin Bradley
*Assistant Examiner*—Alexander Gilman
(74) *Attorney, Agent, or Firm*—Thomas N. Twomey

(57) ABSTRACT

The invention relates to a modularly constructed plug connector comprising at least one plug module which can be plugged into a housing module and can be latched in the housing module, wherein the plug module and the housing module are in each case formed for receiving contact elements, and wherein the plug module has a locking arrangement at least at one outer side by means of which contact elements which are arranged in the plug module and/or in the housing module can be locked.

13 Claims, 7 Drawing Sheets

PLUG CONNECTOR

Figure 1:
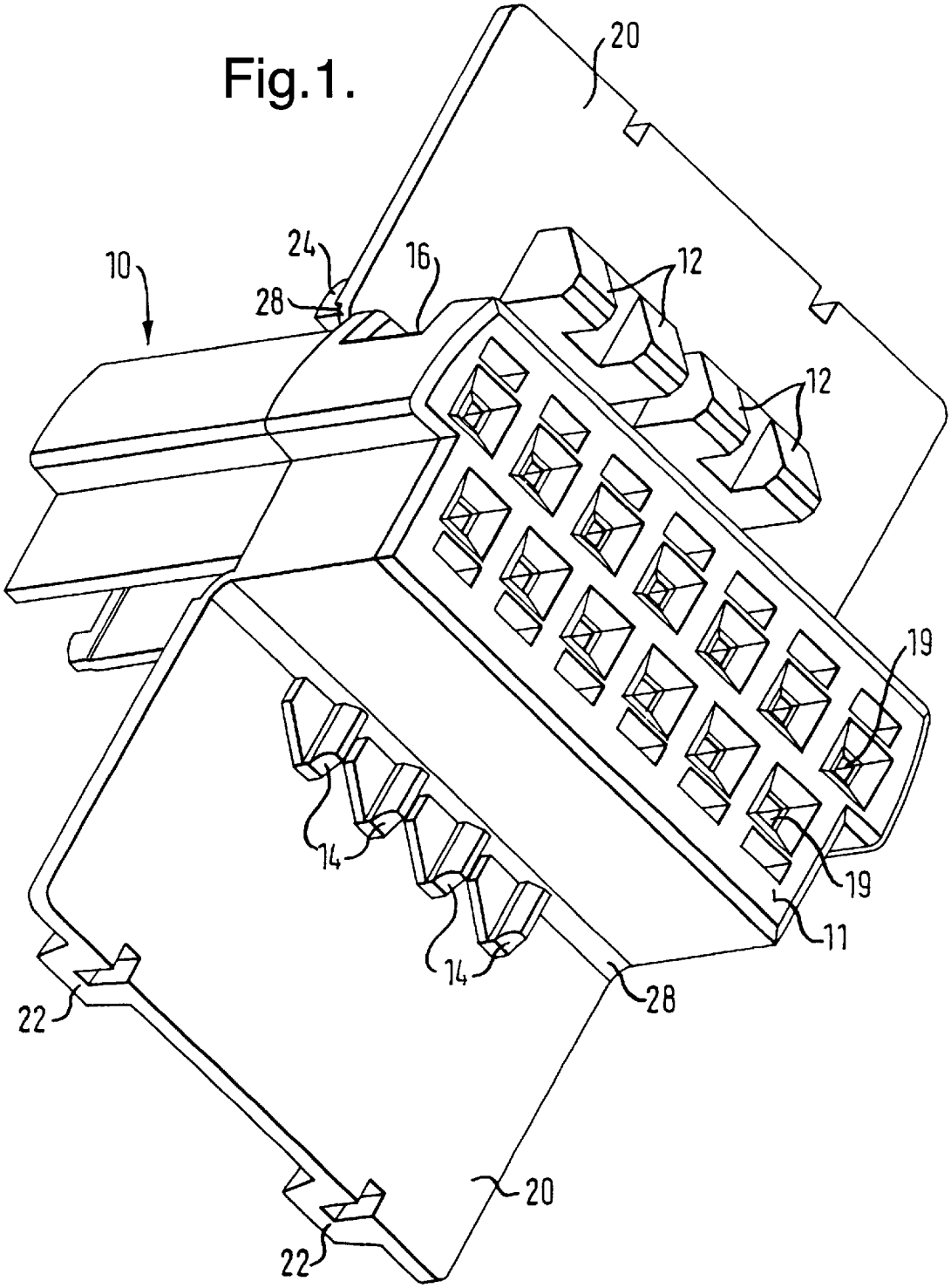

The benefit of the filing date of DE Patent Application 10006890.1 filed Feb. 16, 2000 is claimed.

The invention relates to a modularly constructed plug connector.

The problem (object) of the invention is to create a modularly constructed plug connector which is as simple and reliable to handle as possible.

The plug connector of the present invention has at least one plug module which can be plugged into a housing module and which can be latched in the housing module, wherein the plug module and the housing module are in each case formed for receiving contact elements, and wherein the plug module has a locking arrangement at least at one outer side by means of which contact elements which are arranged in the plug module and/or in the housing module can be locked.

In accordance with the invention no separate constructional element is required for locking the contact elements since the locking takes place through the plug module itself. Through this a space saving and nevertheless reliable locking of the contact elements is achieved.

In a preferred embodiment of the invention the locking arrangement is arranged in such a manner that contact elements of the housing module which are not completely located in a desired position can be pushed into the desired position through the plugging in of the plug module. Through this a particularly simple handling is achieved without impairing the reliability of the plug connector since the correct seating of the contact elements in the housing module is automatically provided for during the plugging in of the plug module.

In a further preferred exemplary embodiment of the invention at least one section of the locking arrangement is arranged at least at one pivotal flap of the plug module. The movability of the flap can be used in an advantageous manner for an additional locking function for contact elements of the plug module.

In this it is preferred when at least one section for contact elements of the housing module and at least one section for contact elements of the plug module are formed at the flap, with the two sections projecting in opposite directions from the flap. Thus for example an outwardly projecting section can be used for the locking of contact elements which are arranged in the housing module, whereas contact elements which can be introduced into the plug module when the flap is pivoted upwards can be locked by a section which protrudes into the plug module when the flap is pivoted downwards.

In accordance with a further preferred embodiment of the invention the housing module is provided with coding sections, past which at least a part of the locking arrangement of a fitting plug module can be moved during the plugging in and which prevent the plugging in of a wrong plug module. In this the locking arrangement thus serves at the same time as a coding for the plug module, through which unintentional combinations of plug modules and housing modules are reliably prevented in a simple way.

The invention also relates to a plugging system consisting of housing modules and plug modules which can be plugged together pair-wise to form a plug connector in accordance with the invention, with each housing module being provided with coding sections, past which at least a part of the locking arrangement of a fitting plug module can be moved during the plugging in and which prevent the plugging in of a wrong plug module.

Preferred embodiments of the invention are also set forth in the subordinate claims, the description and the drawings.

Figure 2:
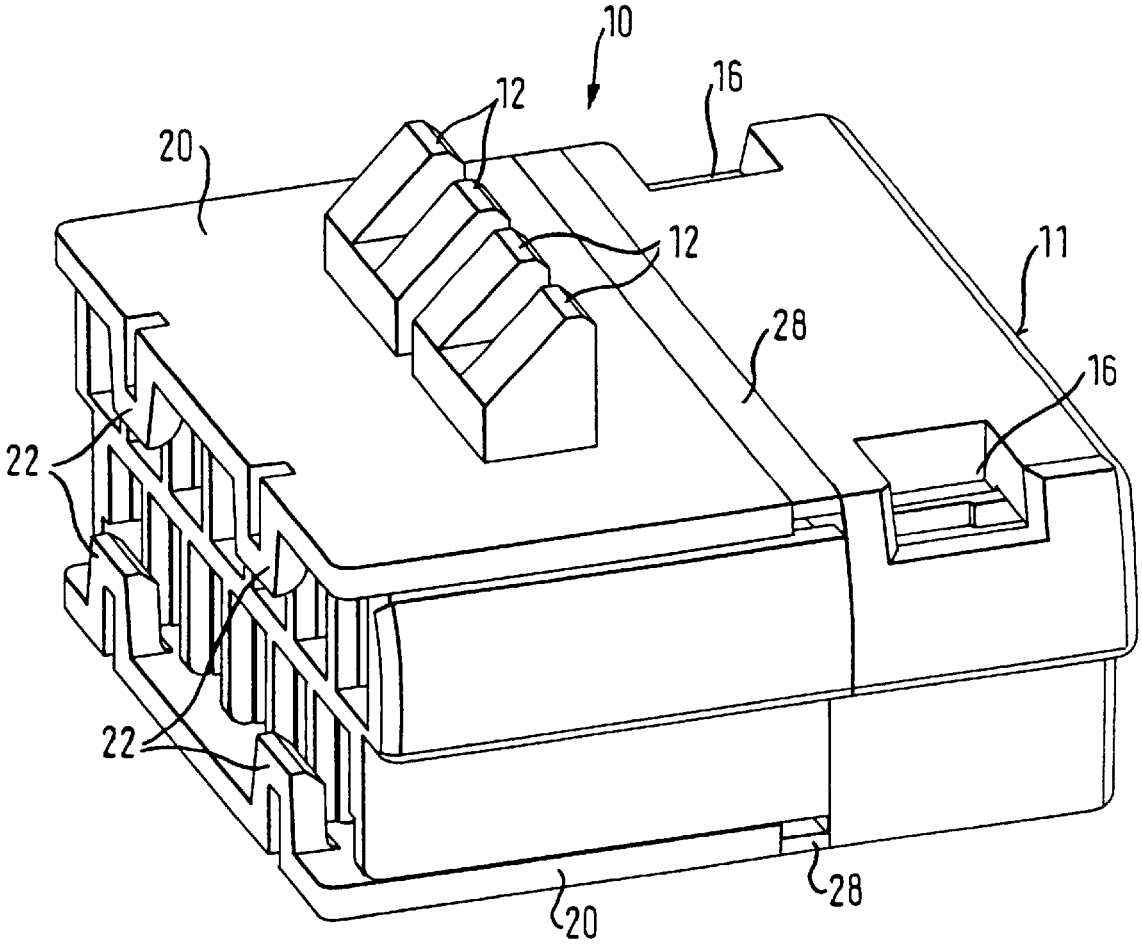
Figure 3:
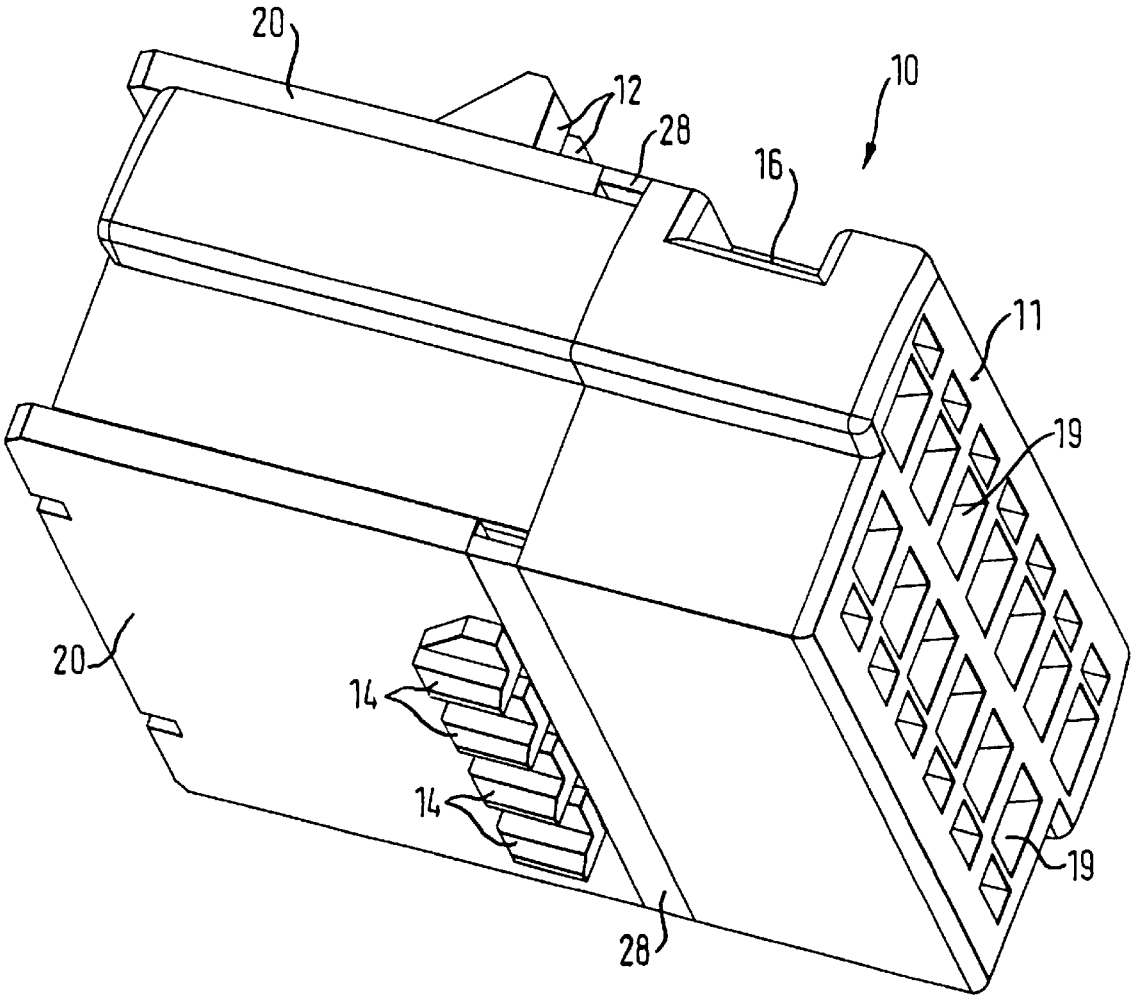
Figure 4:
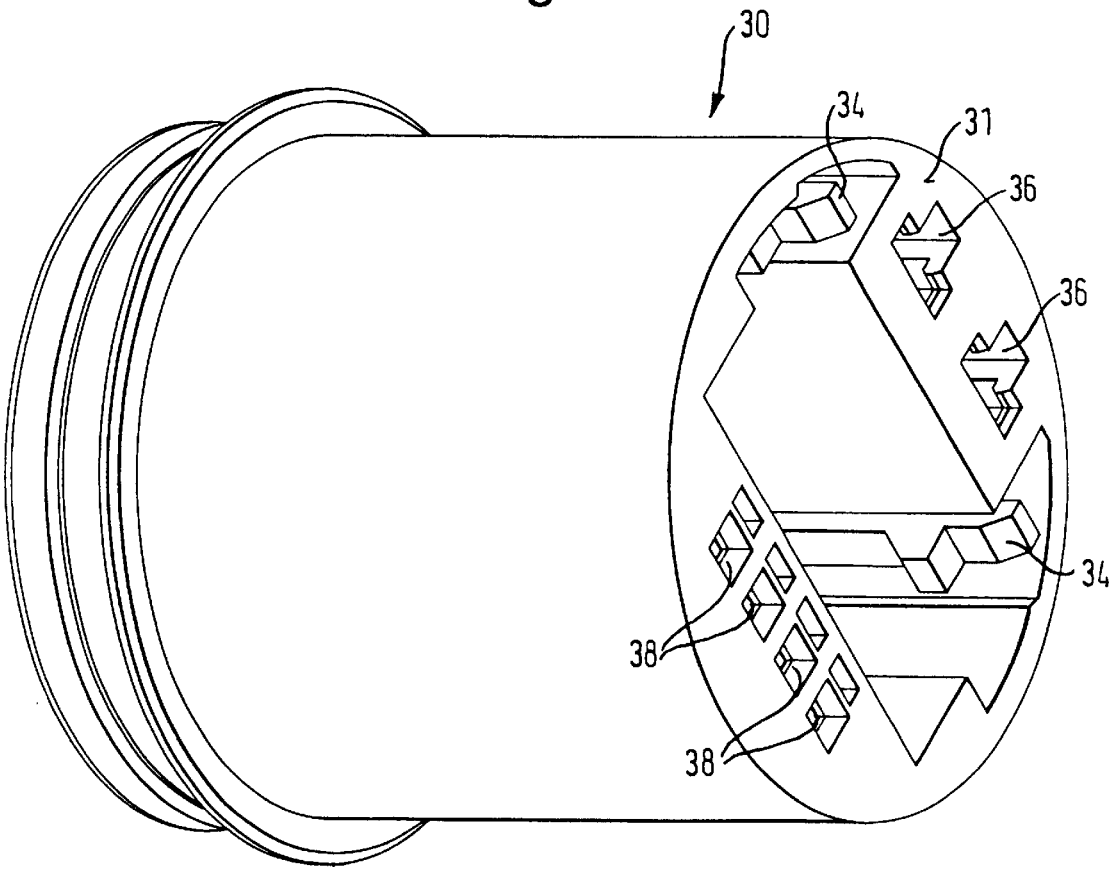
Figure 5:
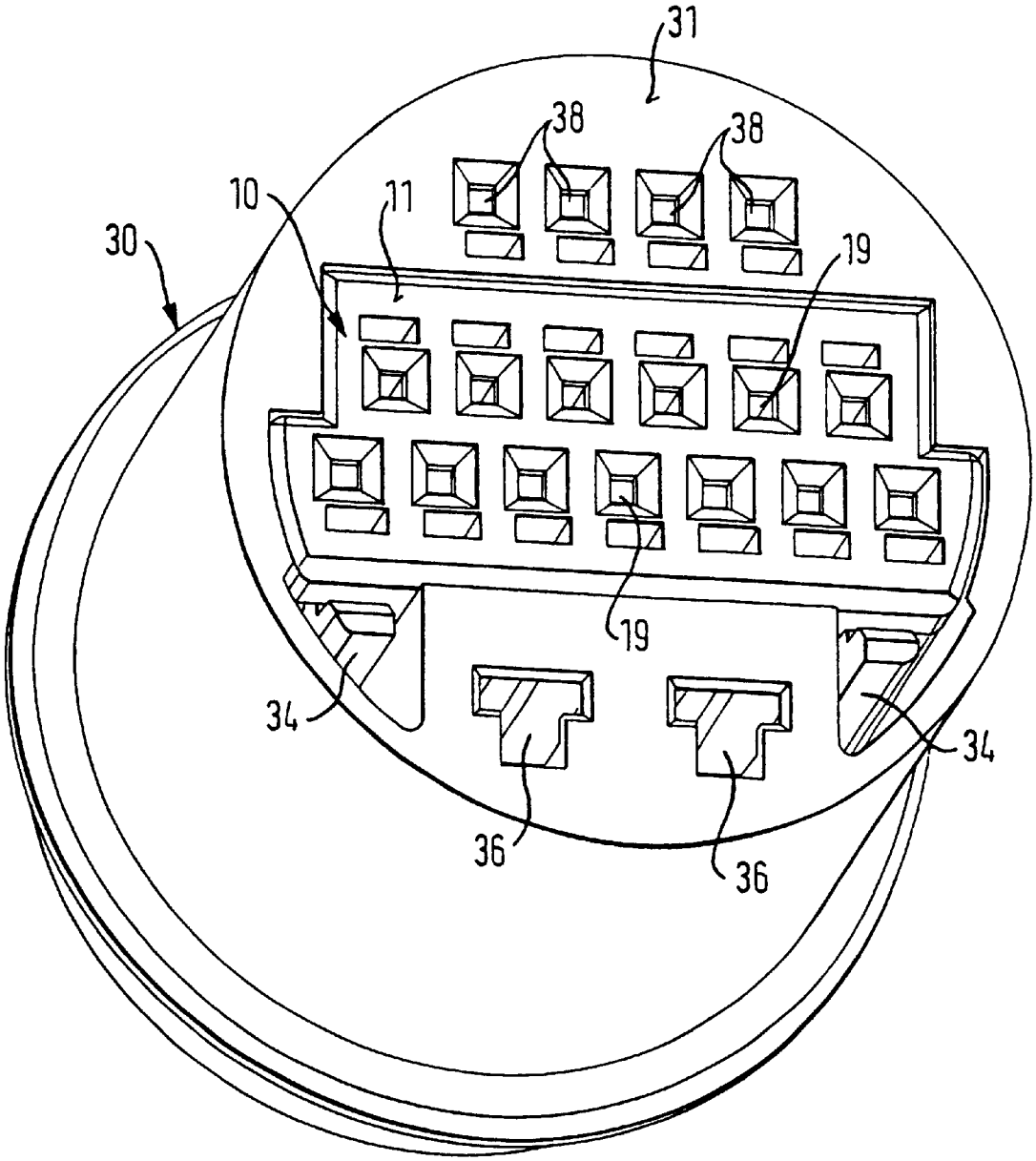
Figure 6:
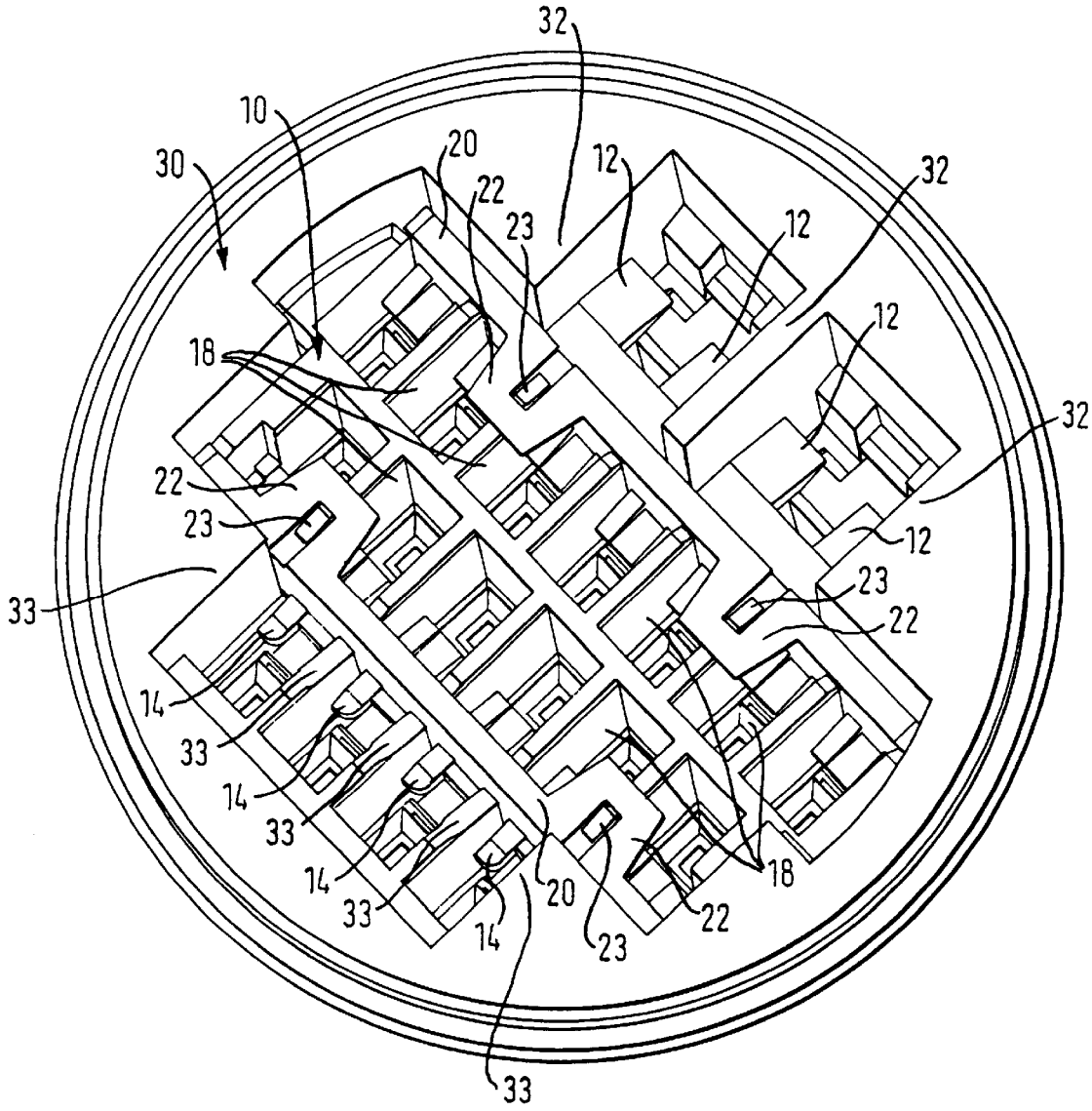
Figure 7:
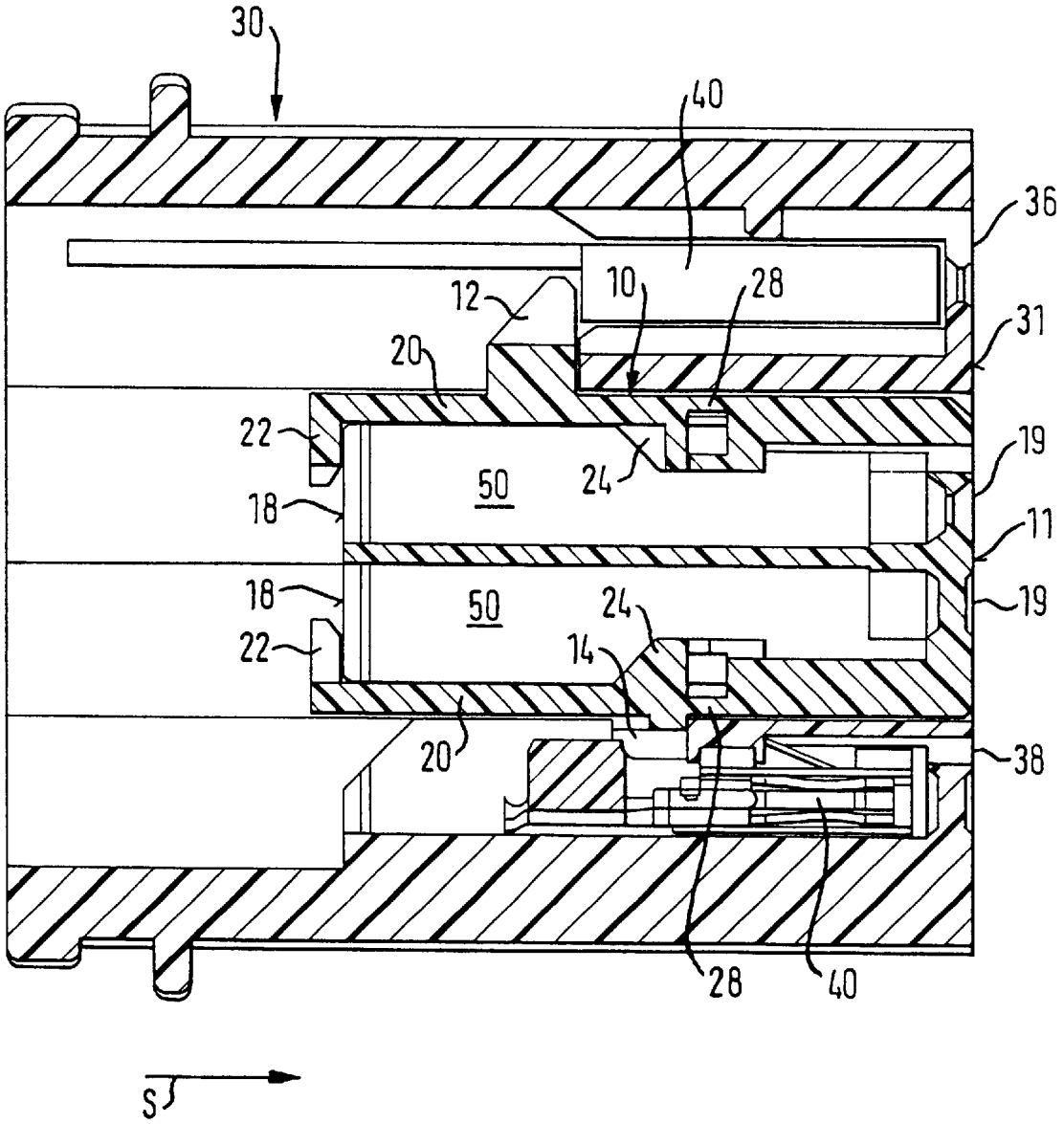

The invention will be described in an exemplary manner with reference to the drawings. Shown are:

FIGS. 1–3 perspective views of a plug module of a plug connector in accordance with an embodiment of the invention, FIG. 4 a perspective view of a housing module in accordance with an embodiment of the invention which fits with the plug module of FIGS. 1–3, FIG. 5 the plug connector which is assembled from the plug module of FIGS. 1–3 and the housing module of FIG. 4 in a perspective view of the contact side, FIG. 6 a perspective view of the rear side of the plug connector of FIG. 5, and FIG. 7 a plug connector corresponding to FIG. 5 and FIG. 6 in a sectioned side view.

The plug module 10 of the plug connector in accordance with the invention which is illustrated in FIGS. 1–3 has a shallow housing in the shape of a rectangular parallelepiped, in which a plurality of reception spaces for non-illustrated contact elements are provided in two rows lying one above the other. FIG. 1 shows the contact side 11 of the plug module 10, in which contact openings 19 are formed via which electrical and mechanical connections to the contact elements which are arranged in the plug module 10 can be produced.

The plug module 10, which is manufactured in a single piece and of plastic, is provided in each case at oppositely lying sides with a flap 20, which in the downwardly pivoted, closed state forms a part of the respective side wall which starts from the rear end of the plug module 10. A film hinge 28 is in each case provided as a joint for the flaps 20.

Each flap 20 is provided with a locking arrangement, which comprises locking elements 12 and 14 respectively which project outwardly in the region of the film hinge 28, locking elements 24 which project from its inner side as well as locking elements 22 which project inwardly at its free end.

The outwardly projecting locking elements 12, 14 are in each case arranged with spacing from one another on a straight line which extends perpendicularly to the longitudinal axis of the plug module 10. The locking elements 12, 14 of the two flaps 20 differ from one another. Whereas in the one flap 20 each locking element 14 has its own pedestal, in the oppositely lying flap 20 the locking elements 12 are in each case arranged pair-wise on a common pedestal. At their side which faces away from the contact side 11 the locking elements 12, 14 are in each case chamfered.

The locking elements 12, 14 thus form in each case a comb-like locking strip in which the locking elements 12, 14 project perpendicularly from the outer side of the respective flap 20.

In the same way the locking elements 24 which project from the inner sides of the flaps 20, and which will be discussed in more detail in connection with FIG. 7, each form a comb-like locking strip.

The locking elements 22, which are provided with slit-like apertures, at the free ends of the flaps 20 serve for the latching of the flaps 20 in the closed position at the plug module 10. In addition, as FIG. 2 shows, some of the access openings 18 to the reception spaces for the contact elements are partly blocked by the locking elements 22.

In accordance with the invention the plug module 10 is thus provided at oppositely lying outer sides in each case with a pivotal locking arrangement in the form of a flap 20 which carries different locking elements.

The upper half of the plug module 10 in FIGS. 1–3, which comprises seven reception spaces for contact elements, is broader than the lower half, which comprises six reception spaces. In the front region between the film hinge 28 and the contact side 11 lateral cut-outs 16 are in each case provided, which serve for the latching of the plug module 10 in a housing module which will be described in more detail in the following.

The cylindrical housing module 30 in accordance with FIG. 4 has a reception space for the plug module 10 which is complementary to the cross-section of the plug module 10. FIG. 4 shows a contact side 31 of the housing module 30, which is manufactured in a single piece and of plastic, in which two contact openings 36 are formed on one side of the reception space and four contact openings 38 are formed on the oppositely lying side, via which non-illustrated contact elements which are arranged in the housing module 30 can be contacted.

The contact openings 36, 38 on both sides of the reception space for the plug module 10 differ from one another and are matched to differently formed contact elements.

On both sides of the contact openings 36 a latching arm 34 which serves for the latching of the plug module 10 in the plugged in state is in each case provided in the reception space of the housing module 30. This is seen in FIG. 5, which shows the plug connector in accordance with the invention in the assembled state, i.e. when the plug module 10 is plugged into the housing module 30.

The contact side of the plug connector is formed together by the contact side 11 of the plug module 10 and the contact side 31 of the housing module 30. The plugging in of the plug module 10 is possible in only one orientation relative to the housing module 30 as a result of its asymmetrical cross-section and of the correspondingly formed reception space in the housing module 30.

The view of the rear side of the assembled plug connector in accordance with FIG. 6 shows the latching of the locking elements 22 which are formed at the flaps 20 by means of latching sections 23 at the rear side of the plug module 10. In addition it can be recognized that two adjacent access openings 18 to the reception spaces of the plug module 10 are partly blocked by each locking element 22.

The access openings in the housing module 30 for the non-illustrated contact elements are bounded by sections 32 on the one side and sections 33 on the other side of the reception space for the plug module 10. These sections 32, 33 are designed in dependence on the locking arrangement of a fitting plug module 10 in such a manner that the locking elements 12 and 14 respectively, which project from the outer sides of the flaps 20, can be moved past the sections 32 and 33 respectively during the plugging in of the plug module 10. In addition the locking elements 12 and 14 respectively are guided by these sections 32, 33 in the housing module 30 during the plugging in of the plug module 10.

The sections 32, 33 of the housing module 30 thus serve on the one hand as coding sections, which ensure that only plug modules 10 with fitting locking elements 12 and 14 respectively can be plugged in and on the other hand as guiding means for a definite introduction of the plug module 10.

In the plug connector in accordance with the invention, therefore, the housing module 30 can be regarded as a lock and the plug module 10 as a key, which can be individualized through different forming of the locking elements 12, 14.

FIG. 7 shows the method of operation of the locking elements 12, 14, 22, 24 of the plug module 10. In contrast to FIG. 6, the rear side of the plug module 10 lies deeper in the interior of the housing module 30 in the embodiment which is illustrated in FIG. 7.

The contact elements 40, which are accommodated on oppositely lying sides of the plugged in plug module 20 in the housing module 30, are designed differently in the example which is illustrated here, with the locking elements 12 and 14 respectively which project outwardly from the flaps 20 being matched to the respective contact elements 40.

The contact elements 40 are already locked in their desired position prior to the plugging in of the plug module 10 through suitable means of the housing module 30, which can in principle be designed in any manner desired. The locking elements 12 and 14 respectively of the plug module 10, which engage behind the contact elements 40, thus form a secondary locking.

The locking elements 24, which project from the inner sides of the flaps 20, protrude in each case into a reception space 50 for a non-illustrated contact element of the plug module 10 and are designed such that the relevant contact element is locked in the plug module 10.

When the contact elements are already firstly locked in the plug module 10 through means of the plug module, which can in principle be designed in any desired manner, then a secondary locking is likewise caused by the locking elements 24 after the closing of the flaps 20.

For the assembly of the plug connector in accordance with the invention the contact elements are first inserted into the reception spaces 50 when the flaps 20 are pivoted upward. Through closing of the flaps 20 the contact elements are then locked or secondly locked respectively by means of the inwardly projecting locking elements 24 and are thus secured against a drawing out. The flaps 20 are latched at the plug module 10 by means of the rear locking elements 22 and are thus reliably held in the closed position.

As soon as the contact elements 40 of the housing module 30 have been inserted into the corresponding reception spaces, the plug module 10 is introduced into the housing module 30 in the plugging direction S until it latches in into its final position through cooperation of the latching arms 34 of the housing module 30 and the cut-outs 16 which are formed at the plug module 10 (cf. FIG. 5).

Through the locking elements 12, 14, 22, 24 both the contact elements 40 of the housing module 30 and the contact elements of the plug module 10 are secondly locked and secured respectively in their desired position.

Contact elements 40 of the housing module 30 which are not located completely in their desired position prior to the plugging in of the plug module 10 are automatically pressed forwardly into their respective desired position by the locking elements 12, 14 during the introduction of the plug module 10.

Thus through the invention a simple to handle plugging system of high reliability is created, in which coding sections 32, 33 of the housing module 30 ensure that only fitting plug modules 10 can be introduced into a relevant housing module 30 and it is ensured in addition that in the assembled state of the plug connector all contact elements 40 are located in their desired position and are secured against a drawing out.

What is claimed is:

1. A modularly constructed plug connector comprising at least one plug module which can be plugged into a housing module and can be latched in the housing module, the plug module and the housing module being formed for receiving contact elements, the plug module having a locking arrangement including at least one locking element which engages the housing module, and wherein the locking arrangement is arranged in such a manner that contact elements of the housing module which are not completely located in a desired position can be pushed into the desired position through plugging in of the plug module.

2. Plug connector in accordance with claim 1, wherein the locking arrangement is effective as a secondary locking device for at least some contact elements of the housing module.

3. Plug connector in accordance with claim 2, wherein the locking arrangement is formed in a single piece with the plug module.

4. Plug connector in accordance with claim 3, wherein a first section of the locking arrangement is formed as a locking strip which extends approximately perpendicular to the plugging direction of the plug module.

5. Plug connector in accordance with claim 4, wherein the first section of the locking arrangement comprises a plurality of locking elements which are arranged along a straight line with spacing from one another.

6. A modularly constructed plug connector comprising at least one plug module which can be plugged into a housing module and can be latched in the housing module, the plug module and the housing module are formed for receiving contact elements, the plug module having a locking arrangement including at least one locking element which engages the housing module, the locking arrangement being arranged in such a manner that contact elements of the housing module which are not completely located in a desired position can be pushed into the desired position through plugging in of the plug module, the locking arrangement being effective as a secondary locking device for at least some contact elements of the housing module, wherein the locking arrangement is formed in a single piece with the plug module, and a first section of the locking arrangement is formed as a locking strip which extends approximately perpendicular to the plugging direction of the plug module, the first section of the locking arrangement comprising a plurality of locking elements which are arranged along a straight line with spacing from one another, and wherein the plurality of locking elements project like teeth of a comb from the plug module.

7. Plug connector in accordance with claim 6, wherein the locking arrangement is arranged at least at one pivotal flap of the plug module.

8. Plug connector in accordance with claim 7, wherein the locking arrangement includes at least a first and a second sections formed at the flap, with the two sections projecting approximately in opposite directions from the flap.

9. Plug connector in accordance with claim 8, wherein the flap forms at least a part of a side wall of the plug module.

10. Plug connector in accordance with claim 9, wherein the flap is pivotally attached via at least one film hinge.

11. Plug connector in accordance with claim 10, wherein the plug module has at least two flaps at two mutually oppositely lying sides.

12. Plug connector in accordance with claim 11, wherein the at least two sections of the locking arrangement differ from one another.

13. Plug connector in accordance with claim 12, wherein the housing module is provided with coding sections, past which at least a part of the first section of the locking arrangement of a fitting plug module can be moved during the plugging in and which prevent the plugging in of a wrong plug module.

* * * * *